United States Patent [19]

Agarwala et al.

[11] 4,350,933

[45] Sep. 21, 1982

[54] TWO-WIRE BALLAST FOR FLUORESCENT TUBE DIMMING

[75] Inventors: Poonam Agarwala, St. Paul; Zoltan Zansky, Roseville, both of Minn.

[73] Assignee: Honeywell Inc., Minneapolis, Minn.

[21] Appl. No.: 210,649

[22] Filed: Nov. 26, 1980

[51] Int. Cl.[3] ..... H05B 41/16; H05B 41/39

[52] U.S. Cl. ..... 315/278; 315/106; 315/199; 315/224; 315/282; 315/291; 315/DIG. 4

[58] Field of Search ..... 315/106, 194, 199, 224, 315/278, 282, 291, DIG. 4, DIG. 7

[56] References Cited

U.S. PATENT DOCUMENTS

| | | | |
|---|---|---|---|
| 2,940,008 | 6/1960 | Strecker | 315/278 |
| 3,247,422 | 4/1966 | Schultz | 315/206 |
| 3,969,652 | 7/1976 | Herzog | 315/224 |
| 4,017,762 | 4/1977 | Wheeler | 321/2 |
| 4,042,852 | 8/1977 | Zaderes et al. | 315/97 |
| 4,100,476 | 7/1978 | Ghiringhelli | 315/DIG. 4 |
| 4,163,925 | 8/1979 | Gyursanszky | 315/276 |
| 4,207,497 | 6/1980 | Capewell et al. | 315/96 |
| 4,207,498 | 6/1980 | Spira | 315/97 |
| 4,210,846 | 7/1980 | Capewell et al. | 315/121 |

OTHER PUBLICATIONS

Cohen, Charles, "Transistor Ballast Cuts Power Loss", *Electronics*, Sep. 13, 1979, pp. 78, 80.

Haver, Robert J., "The ABC's of DC to AC Inverters", Motorola Semiconductor Products, Inc., Apr. 1975.

Roddam, Thomas, "Transistor Inverters and Converters", Chapter 10 of *Design of Solid State Power Supplies*, date unknown, Princeton, N.J.

Haver, Robert J., "The Verdict Is In: Solid-State Fluorescent Ballasts are Here", *EDN*, Nov. 15, 1976.

*Primary Examiner*—Eugene R. La Roche

*Attorney, Agent, or Firm*—Charles G. Mersereau

[57] ABSTRACT

A two-wire ballast arrangement for fluorescent lamp dimming is disclosed in which a modified transformer utilizing the natural leakage inductance associated with ballast transformers is used to achieve full-range fluorescent tube dimming at substantially constant filament heating voltage. Additional auxiliary secondary windings are disposed in predetermined spaced relationship to the primary winding and the main secondary winding to create a "tapping" effect in the magnetic flux. The mutual leakage inductances of the auxiliary secondaries in relation to the primary and the main secondary is utilized in a manner such that as the voltage is decreased to the primary, the voltage of the auxiliary secondary windings remains substantially constant to hold the filament heating voltage substantially constant. Embodiments are disclosed for use either with conventional 50/60 Hz or at high frequency, i.e. above 400 Hz.

5 Claims, 9 Drawing Figures

TWO-WIRE BALLAST FOR FLUORESCENT TUBE DIMMING

CROSS-REFERENCE TO RELATED APPLICATIONS

Cross-reference is made to two related applications filled of even date herewith and assigned to the same assignee as the present application. The first, Ser. No. 210,650, entitled "Two-wire Electronic Dimming Ballast for Gaseous Discharge Lamps," and the second related application Ser. No. 210,651, entitled "Two-wire Electronic Dimming Ballast for Fluorescent Lamps," were both invented by Zoltan Zansky, a co-inventor of the present application.

The first cross-referenced application concerns a high frequency electronic ballast dimming arrangement which utilizes a pulse width modulated input to a push-pull or half-bridge inverter in combination with the employment of secondary windings in the transformer which utilize the leakage inductance of the transformer to maintain constant cathode voltage during dimming. The second cross-referenced application concerns a high frequency electronic ballast dimming arrangement which uses a resonant bridge inverter which may be dimmed by applying a pulse width modulated drive to the switching transistors or by variation of the AC source voltage to a rectification system. The main secondary of the transformer is eliminated in this manner, and constant cathode filament voltage is maintained during dimming by other means. The present invention, on the other hand, concerns advances in the transformer of a conventional dimming ballast which eliminate the need for an external inductor or choke coil associated with maintaining the desired cathode filament voltage during dimming. The function of the choke coil is replaced with secondary windings in the transformer which utilize the natural leakage inductance of the transformer to obtain the desired results.

BACKGROUND OF THE INVENTION

1. Field of the Invention

This invention relates to a ballast arrangement for fluorescent tubes and particularly to a two-wire ballast arrangement which utilizes the leakage inductance of the transformer to achieve a supply of substantially constant filament voltage to fluorescent tubes supplied by a variable power source for dimming.

2. Description of the Prior Art

Typical fluorescent tubes comprise a sealed cylinder of glass having a heating filament at either end and filled with a gas such as mercury vapor. The supplied voltage is utilized to heat the filaments to a point where a thermionic emission occurs such that an arc can be struck across the tube causing the gas to radiate. The initial radiation given off by gases such as mercury vapor is of a short wavelength principally in the ultraviolet end of the spectrum and thus little visible light is produced. In order to overcome this problem, the inside of the tube is coated with a suitable phosphor which is activated by the ultraviolet radiation, and, in turn, emits visible light of a color that is characteristic of the particular phosphor or mixture of phosphors employed to coat the tube. An important consideration in the operation of such fluorescent tubes is concerned with the fact that in order to sustain the arc across the tubes, the filament voltage must be maintained to a predetermined level. It is maintaining this predetermined voltage level which poses the greatest problem in devising a scheme for dimming the output of the fluorescent tube in an energy-saving, light-dimming arrangement.

As one answer to this problem, the prior art developed a three-wire system where the filament voltage was separated from the variable current used to dim the fluorescent tube. In such a system, a first wire was used to supply variable current to the fluorescent tube. A second wire was used to supply constant filament voltage to the filament of the tube. The third wire was used as a return. Although this arrangement was somewhat successful in accomplishing the required fluorescent tube dimming, the costs from the standpoint of both the device itself and of installation of the device were such that a two-wire system more compatible with present installations was preferable.

Earlier prior art two-wire fluorescent tube dimming arrangements were also developed but these provided only a limited dimming capability beyond which the tube would not function. One problem with these early prior art two-wire dimming arrangements was that the filament voltage to the tube in fact varied as the power supplied to the fluorescent tube was varied. As the current supplied to the fluorescent lamp(s) was reduced, the filament voltage was reduced resulting in damage to the lamps by stripping the emission coating from the cathodes, and eventually extinguishing the lamp current when the filament voltage was reduced below the level required to sustain the arc across the tube.

One prior art solution to these problems is found in U.S. Pat. No. 4,163,925 issued Aug. 7, 1979 invented by Zoltan L. Gyursanszky (now Zoltan Zansky), a co-inventor in the present application. That application is assigned to the same assignee as the present invention. By that invention, a two-wire ballast for fluorescent dimming was provided in which first and second terminals were utilized to provide variable dimming power to the fluorescent tube utilizing a choke coil in conjunction with the transformer. Thus, the choke coil was connected between the first terminal and the tube and a transformer was provided having a primary winding connected between the second terminal and a tap on the choke coil selected to provide substantially constant voltage to the primary winding even as the power to the tube is varied. The transformer had a secondary winding associated with the primary winding to supply filament voltage to the filaments of the tube. While this arrangement provided a solution to many of the problems of the prior art, the necessity for providing the choke coil in the system caused the cost level of the assembled ballast to remain above the point where it would be competitive with other ballasts.

SUMMARY OF THE INVENTION

By means of the present invention, many of the problems associated with prior art dimmable fluorescent ballasts are solved by the provision of a two-wire system in which all inductance devices other than the necessary transformer are eliminated. The two-wire ballast arrangement of the present invention contemplates utilizing the natural leakage inductance associated with the voltage transformer of the fluorescent ballast to achieve full range fluorescent tube dimming at substantially constant heater filament voltage. This is accomplished by connecting additional secondary windings associated with the transformer primary and main secondary winding across each tube heater filament. The additional secondary windings are disposed in predetermined spaced relation to the primary winding and the main secondary winding to create a "tapping" effect in the magnetic flux. This is done by adjusting the mutual leakage inductances of the secondaries in relation to the primary and the main secondary such that as the power is decreased to the primary, the voltage of the main secondary increases, and the voltage of the other secondaries remains constant to hold the filament heating voltage substantially constant. This takes advantage of the natural leakage inductance of the transformer and accomplishes results at least as desirable as the prior art devices without the need of a choke coil. Additional properly disposed secondaries may be added to the system to accommodate additional fluorescent tubes.

The basic solution associated with the present invention in which placement of additional secondary windings is made in relation to the primary transformer winding and the main secondary transformer winding is especially useful in the case of high frequency alternating current systems in which the necessary leakage inductance is easily attainable, i.e., where the frequency is above 400 Hz. The system is also made adaptable to the 50/60 Hz environment by inserting magnetically conductive shunts of the same core material as the main transformer core to increase the low frequency leakage inductances to the desired values for this use. Elimination of the choke coil greatly reduces the cost of the system.

BRIEF DESCRIPTION OF THE DRAWINGS

In the drawings wherein the like numerals are utilized to denote like parts throughout the same.

DETAILED DESCRIPTION

Figure 1:
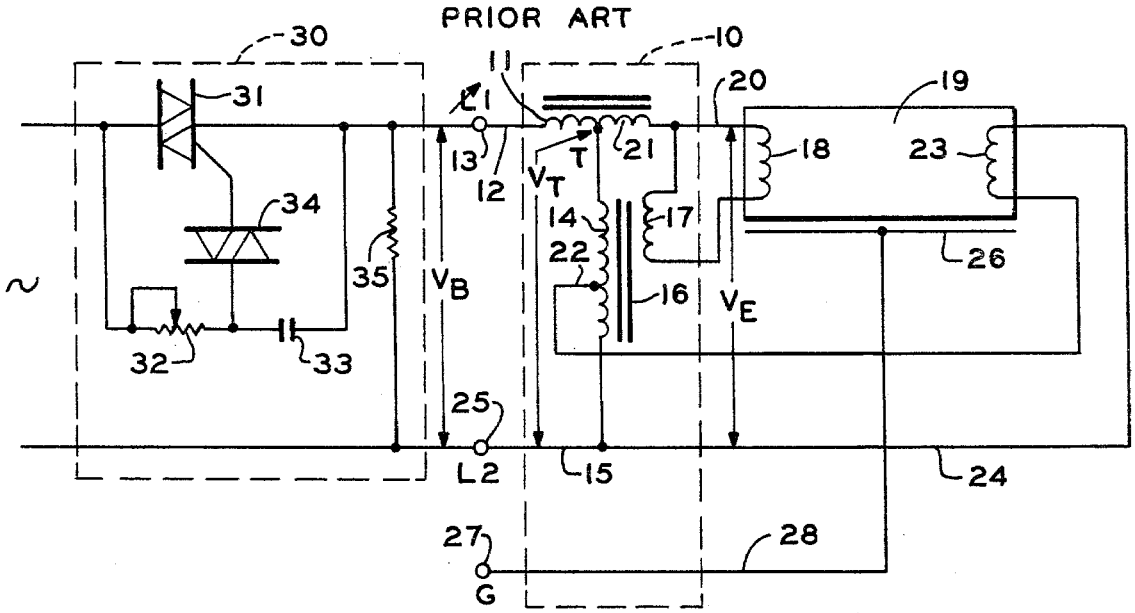
FIG. 1 is a prior art two-wire arrangement for dimming a fluorescent tube including an inductive choke coil.

FIG. 1 depicts the typical arrangement of a prior art dimmable ballast utilizing a tapped choke coil arrangement. In FIG. 1, the ballast enclosed by the dashed lines at 10 includes a choke coil 11 which has a tap T selected to produce a substantially constant voltage in accordance with the remainder of the ballast circuit. A first wire 12 connects choke coil 11 to the variable current or power supply terminal 13. The primary winding 14 is connected between the tap T on choke 11 and a second wire 15. The filament supply transformer 16 has a secondary winding 17 connected across one filament 18 of the fluorescent tube 19. The filament 18 is also connected to the downstream side of the choke coil via conductor 20 at 21. A second secondary winding comprises tap 22 of primary winding 14 which tap is connected to one side of the second filament 23 of the fluorescent tube 19. The other side of filament 23 is connected as by line 24 and second wire 15 to the second line terminal 25. The fluorescent tube further includes a starting stripe 26 connected to a ground 27 as by line 28. Tap T is selected such that the voltage at tap T on choke coil 11 is substantially constant as the current therethrough varies. Therefore, the filament transformer 16 will supply substantially constant voltage to filaments 18 and 23 of fluorescent tube 19. In this manner, the filament voltage and emission temperature will be maintained substantially constant throughout the whole dimming range.

In order to dim fluorescent tube 19, a dimming circuit 30 is provided connected between a source of alternating current and terminals 13 and 25. The dimming circuit 30 includes a solid-state semiconductor switch or triac 31 which has one side connected to one side of the alternating current source and the other side connected to the terminal 13. A series combination of variable resistance 32 and capacitor 33 are connected across the triac 31 and a diac 34 is connected from the junction of variable resistance 32 and capacitor 33 to the gate terminal of triac 31. An additional resistor 35 is connected from the junction of triac 31 and terminal 13 to the junction of the other side of the alternating current source and terminal 25 in a well known manner. The dimming control circuit 30, then, is a phase control circuit which controls the amount of current supplied to terminal 13 by the setting of the variable resistance 32.

The two-wire fluorescent arrangement of FIG. 1 does accomplish substantially full-range dimming of the fluorescent tube 19 in conjunction with changes in the AC power supply. However, this system has the drawback that it requires the inclusion of an inductive element, namely the choke coil 11 which places the cost of the ballast above what the typical consumer is willing to pay.

Figure 2:
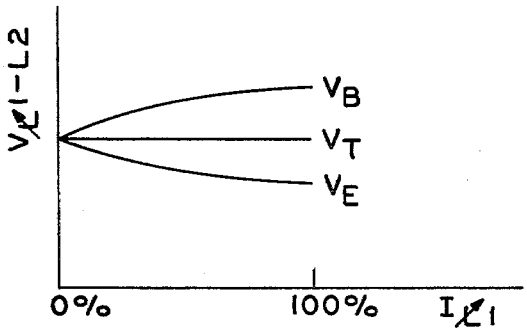
FIG. 2 shows the voltage vs. the controlled current through the tube in accordance with FIGS. 1, 6, 6*a*, 7, and 7*a*.

FIG. 2 is a plot of voltage vs. controlled current through the tube associated with the circuit of FIG. 1 and also FIGS. 6, 6*a*, 7, and 7*a* as illustrated. In relation to FIG. 1, the voltage $V_T$ represents a voltage at the tap of the choke coil which is selected to be connected to the primary of the filament supply transformer and is a constant or substantially constant voltage as the dimming current is varied. $V_B$ represents the voltage across the primary winding, and $V_E$ represents the voltage across the fluorescent lamp load.

In relation to FIGS. 6, 6*a*, 7, and 7*a*, the voltage $V_T$ represents the voltage across the auxiliary secondary windings of the lamp supply transformer which remains substantially constant during dimming. $V_B$ represents the voltage across the primary winding which decreases during dimming, and $V_E$ represents the voltage across the main secondary which increases during dimming. The present invention retains the advantages associated with a two-wire dimming system such as that generally depicted in FIGS. 1 and 2 but eliminates the necessity of using additional expensive inductance components such as the choke coil. The present invention contemplates eliminating the need for the choke coil by taking advantage of the leakage inductance characteristics of a modified transformer. In this regard, FIGS. 3-5 show typical modified filament transformer embodiments.

Figure 3:
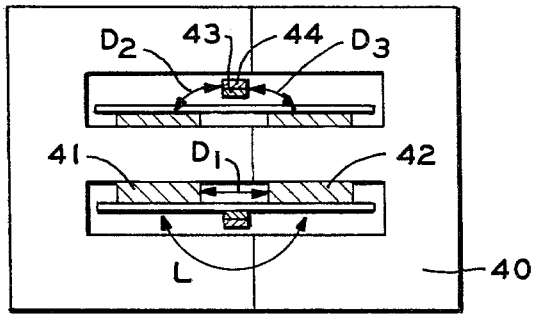
FIG. 3 is a schematic sectional view of a transformer in accordance with one embodiment of the present invention.

FIG. 3 depicts a modified transformer including a "soft", e.g. ferrite, magnetic core 40 having a primary winding 41, associated main secondary winding 42, and auxiliary secondary windings 43 and 44. The distance between the primary winding 41 and the main secondary winding 42 is denoted $D_1$, that between the primary winding 41 and the auxiliary secondary windings 43 and 44 is denoted by $D_2$ and the distance between the main secondary winding 42 and the auxiliary secondary windings 43 and 44 is denoted by $D_3$.

Figure 4:
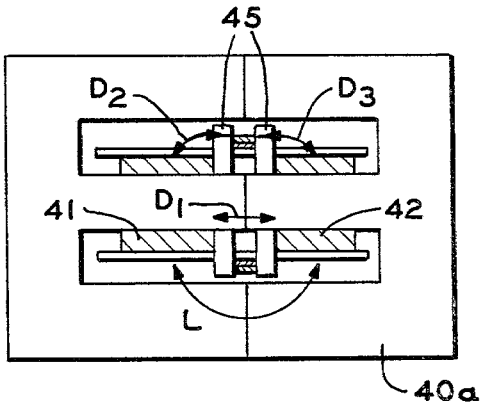
FIG. 4 is a schematic sectional view of a transformer in accordance with another embodiment of the present invention.

FIG. 4 depicts a transformer similar to that in FIG. 3 with the exception that magnetic shunts 45 are provided in the gaps between the transformer windings and a "hard" core 40*a* is used. The magnetic shunts 45 are constructed of the same material as the transformer core 40 and are designed to increase the leakage inductance to the desired value as explained in conjunction with the ballast arrangements of FIGS. 6 and 7, below for low frequency (50/60 Hz) applications.

Figure 5:
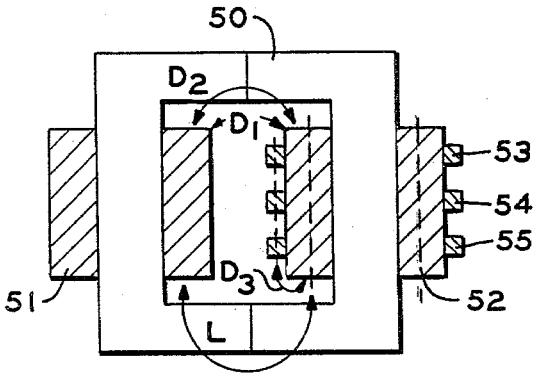
FIG. 5 is a schematic sectional view of a transformer in accordance with yet another possible embodiment of the present invention.

FIG. 5 shows yet another alternate transformer embodiment including a soft magnetic core 50, associated primary winding 51, main secondary winding 52, and auxiliary secondary windings 53, 54, and 55. The path of primary-secondary leakage inductance is denoted L in the drawings.

The construction of the transformer depicted in FIG. 4 differs from that of FIGS. 3 and 5 only with the addition of the magnetic shunts 45 which are utilized to increase the low frequency leakage conductance. The transformer of FIG. 4 uses a laminated iron, or the like, "hard" core and the embodiments of FIGS. 3 and 5 use a ferrite, or the like, high frequency of "soft" core. While the leakage inductances are sufficiently high at higher frequencies (i.e., above 1 KHz) such that no additional magnetic shunts are necessary, at low frequencies the magnetic flux conductance must be enhanced to produce the desired result. Thus, the transformer of FIG. 3 is designed for use with high frequency inputs and that of FIG. 4, with low frequency inputs.

The relationship of the particular construction of the transformers of FIGS. 3-5 including the coil placements to the dimmable ballast of the present invention will now be explained in conjunction with the application thereof as seen in FIGS. 6, 6*a*, 7, and 7*a*.

Figure 6:
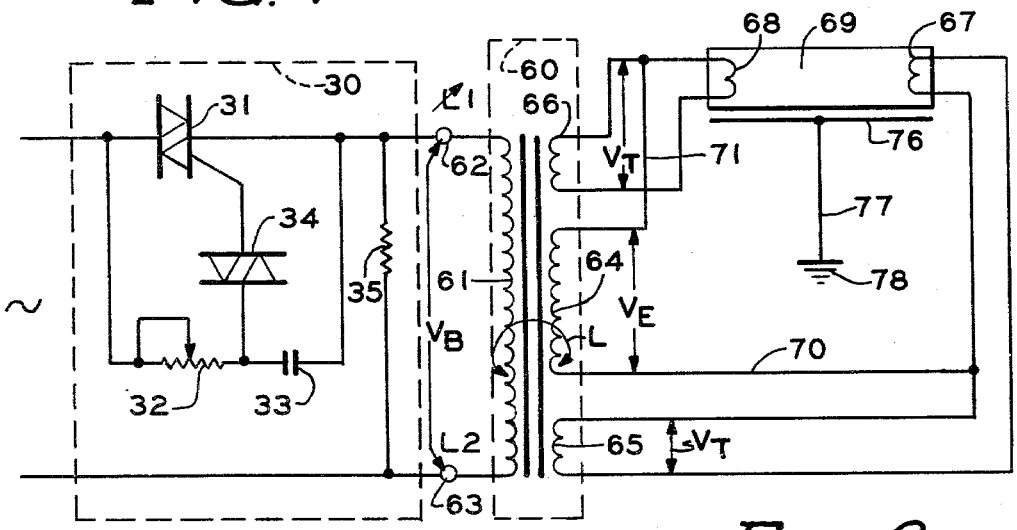
FIG. 6 shows arrangement of the present ballast for supplying a single fluorescent tube from low frequency AC input.

In FIG. 6, there is provided a transformer 60 which may encompass the embodiment shown in FIG. 4. Transformer 60 includes a primary winding 61, one side of which is connected to one side of a two-wire variable current or voltage power supply at terminal 62 and the other side to the second power supply terminal 63. The transformer 60 further includes a main secondary winding 64 and auxiliary secondary windings 65 and 66. The auxiliary secondary windings 65 and 66 are connected across filaments 67 and 68 of fluorescent tube 69, respectively. Main secondary winding 64 is connected by line 70 to filament 67 and by line 71 to filament 68 of the fluorescent tube 69.

A dimming circuit 30 is provided which is connected between the alternating current as from a typical 50/60 Hz AC source and the terminals 62 and 63. Any well known compatible method of varying the alternating current source may be used and the illustrated dimming circuit 30 may be similar to that shown in regard to FIG. 1. Thus, it may include a solid state semiconductor switch or triac 31 having one side connected to one side of the alternating current source and the other side to the terminal 62. A series combination of variable resistor 32 and capacitor 33 connected across the triac 31 and a diac 34 connected from the junction of variable resistance 32 and capacitor 33 to the gate terminal of triac 31 are included. Further resistor 35 is connected from the junction of triac 31 and terminal 62 to the junction on the other side of the alternating current source which connects terminal 63 in a well-known manner. As previously described, the dimming control circuit 30 is a phase control circuit which controls the amount of current supplied to terminal 62 by varying the setting of variable resistor 32. Provision is also made in the system for starting stripe 76 connected by line 77 to a ground terminal depicted by 78.

Figure 6A:
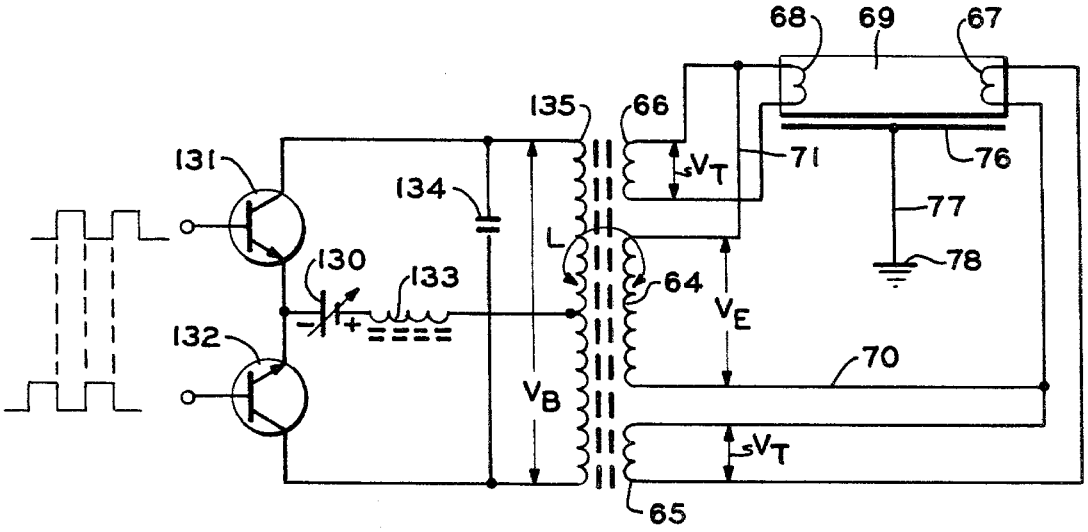
FIG. 6*a* shows the configuration of FIG. 6 with a high frequency input.

FIG. 6*a* shows a simplified circuit diagram of a current-fed, push-pull inverter input to the ballast circuit of FIG. 6 which may be used for high frequency operation of the system with the transformers of FIGS. 3 and 5. It includes for dimming a variable DC source which may be full wave rectified AC current 130 which may be obtained from the AC circuit as by a full wave bridge. The input to the bases of transistors 131 and 132 is also indicated as alternate square waves. External inductor choke coil 133 in series with tuning capacitor 134 is connected between the junction of the emitters of transistors 131 and 132 and a center tap of the primary windings represented by 135 of the high frequency transformer. The capacitor 134 is connected across primary winding 135. The bases of transistors 131 and 132 respectively are supplied with alternating square wave inputs, and the input choke coil and capacitor provide tuned sinusoidal input to the primary windings 135.

Figure 7:
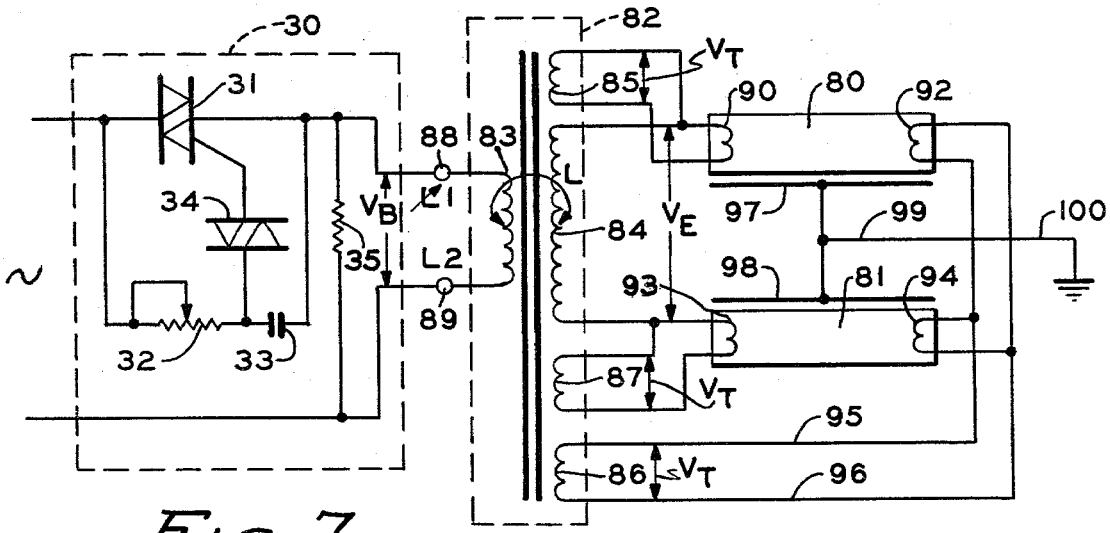
FIG. 7 shows an arrangement of the present ballast for supplying two fluorescent tubes from a low frequency input.

FIG. 7 shows a variation of the circuit of FIG. 6 for supplying two fluorescent tubes 80 and 81. Power is supplied through transformer 82 with primary winding 83, main secondary winding 84, and auxiliary secondary windings 85, 86, and 87. As with the previous embodiment, the primary winding 83 is connected between variable current or power supply terminals 88 and 89. The auxiliary secondary winding 85 is connected across one filament 90 of the fluorescent tube 80 and the auxiliary secondary winding 87 is connected across one filament 93 of fluorescent tube 81 and a third auxiliary secondary winding 86 is connected to the other filaments 92 and 94 of the respective fluorescent tubes 80 and 81 via conductors 95 and 96, as shown. Main secondary winding 84 is connected between filament 90 of fluorescent tube 80 and filament 93 of fluorescent tube 94. Provision is made for starting stripes 97 and 98 connected by line 99 to ground terminal 100. The dimming circuit 101 again may be substantially similar to the circuit 70 as it per se does not constitute a part of the present invention, need not be again described in detail. It should suffice to say that it varies the amount of current supplied to the terminal 88 in a manner as substantially previously described.

Figure 7A:
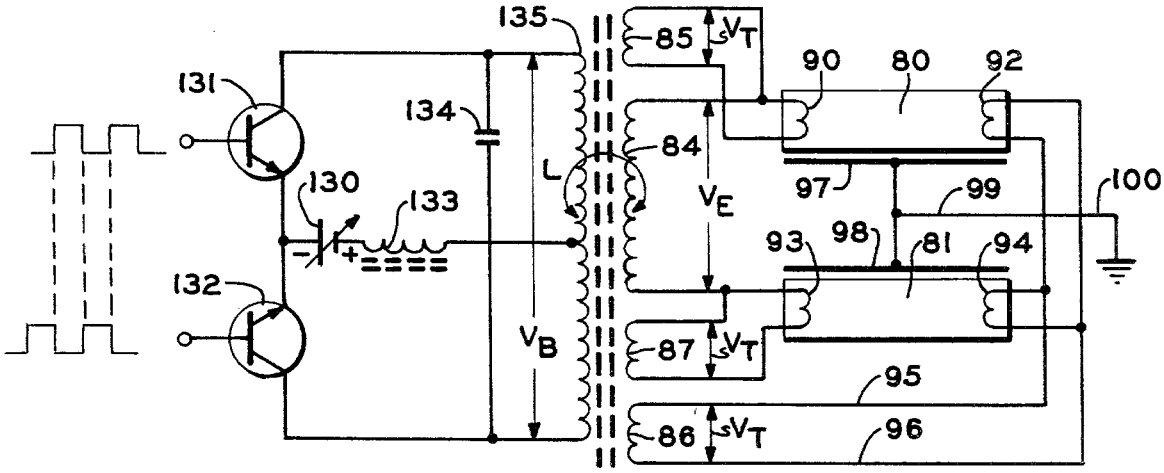
FIG. 7*a* shows the configuration of FIG. 7 with a high frequency input.

FIG. 7*a* depicts the embodiment of FIG. 7 adapted for high frequency use. As in the case of the embodiment of FIG. 6*a*, the transformers of FIGS. 3 and 5 would be used. As the input circuit of FIG. 7*a* is identical to that of FIG. 6*a*, a detailed description need not be repeated.

The circuits depicted in FIGS. 6, 6*a*, 7, and 7*a* operate to dim one or more fluorescent tubes at substantially constant filament heating voltage without the use of a choke coil or other auxiliary inductive device because the necessary inductance relationship is provided by utilizing, and, if necessary, enlarging the leakage inductance of the filament supply transformer. For any given high frequency operating fluorescent or other gas discharge tube, the transformer in accordance with FIG. 3 or 5 may be used. The distances $D_1$, $D_2$, and $D_3$ are determined such that a tapping effect is created in the natural leakage inductance of the transformer. The auxiliary secondary windings are located such that for any given application, a corresponding voltage increase in the main secondary winding is associated with a voltage decrease to the the transformer primary winding. The auxiliary secondary filament transformer windings are located such that the voltage at the filaments of the fluorescent tube or tubes remains substantially constant throughout the dimming range. This value for any given application may be determined experimentally and fixed in the construction of the transformers.

It has been found in accordance with the present invention that by employing the transformer scheme described, the voltage supplied to the filaments of the fluorescent tubes may be held substantially constant over the full dimming range without the necessity of employing any magnetic components or devices in addition to the basic transformer to accomplish dimming. This results in a fluorescent ballast of equal or superior dimming qualities which enjoys a substantially reduced cost over those associated with the prior art.

The embodiments of the invention in which an exclusive property or right is claimed are defined as follows:

1. A two-wire ballast for a fluorescent tube dimming arrangement comprising:

first and second terminals adapted to be connected to source of variable power;

a transformer having a primary winding connected across said first and second terminals said transformer further comprising, first secondary winding having terminals connected across the filaments of a fluorescent tube, second secondary winding having terminals connected across one of said fluorescent filaments, third secondary winding having terminals connected across the other of said fluorescent filaments, and wherein said second and third secondary windings are disposed in predetermined spaced relation to said primary winding and said first secondary winding such that the leakage inductance ratios produced by the disposition of said second and third secondary windings causes the cathode heating voltage supplied to said fluorescent tube filaments to remain substantially constant during variation of the source power.

2. The apparatus of claim 1 further comprising a fourth secondary winding on said transformer disposed in predetermined spaced relation to said primary winding and to said first secondary winding such that the leakage inductance ratio produced by the disposition of said fourth secondary winding with said second and third secondary windings causes a substantially constant filament heating voltage to be provided to a second fluorescent tube during variation of the source power, and wherein said first secondary winding is connected across both fluorescent tubes.

3. The apparatus of claim 2 further comprising additional secondary windings adapted to accommodate additional fluorescent tubes such that a substantially constant filament heating voltage is maintained for all such fluorescent tubes.

4. The apparatus according to any one of claims 1, 2, or 3 wherein said transformer is a high-frequency transformer adapted to operate with a high frequency input.

5. The two-wire ballast according to any one of claims 1, 2, or 3 further comprising magnetically conductive shunt means disposed in the magnetic core of said transformer to increase the low frequency leakage inductance of said transformer.

* * * * *